US005704979A

United States Patent [19]

Jörgens

[11] Patent Number: 5,704,979

[45] Date of Patent: Jan. 6, 1998

[54] PROCESS FOR COATING HOLLOW OBJECTS

[76] Inventor: Klaus Jörgens, Am Flöthen 98, 5600 Wuppertal 1, Germany

[21] Appl. No.: 479,154

[22] Filed: Jun. 7, 1995

Related U.S. Application Data

[62] Division of Ser. No. 65,991, May 21, 1993, Pat. No. 5,474, 610.

[30] Foreign Application Priority Data

May 21, 1992 [DE] Germany ..... 42 16 741.8
Nov. 26, 1992 [DE] Germany ..... 42 39 680.8

[51] Int. Cl.[6] ..... B05C 19/02

[52] U.S. Cl. ..... 118/423; 118/426

[58] Field of Search ..... 427/236, 239; 118/423, 428, 426

[56] References Cited

FOREIGN PATENT DOCUMENTS 0118756 9/1984 European Pat. Off. .
3108549 9/1982 Germany .
59-118885 7/1984 Japan .
2285095 2/1991 Japan .
1015924 4/1984 U.S.S.R. .

*Primary Examiner*—Brenda A. Lamb
*Attorney, Agent, or Firm*—Ostrolenk, Faber, Gerb & Soffen, LLP

[57] ABSTRACT

Process for coating hollow objects exhibiting an opening, and beverage cans in particular, in which the hollow objects are immersed completely and with the opening downward in a paint-filled submersion bath, the openings being moved into the vicinity of nozzles for the paint, which are located underneath the surface of the liquid in the submersion bath and which at least partially displace the air trapped in the hollow objects immersed in the submersion bath by means of streams of paint discharging from the nozzles. With this process hollow objects can be painted uniformly inside and outside in one step without its being necessary to turn them either to fill them with paint when immersed in the submersion bath or to drain them after their being lifted out of the bath.

4 Claims, 2 Drawing Sheets

PROCESS FOR COATING HOLLOW OBJECTS

This is a division of application Ser. No. 08/065,991, filed May 21, 1993 now U.S. Pat. No. 5,474,610.

The invention applies to a process for coating hollow objects exhibiting an opening and beverage cans in particular.

BACKGROUND OF THE INVENTION

The immersion process, the flow-coating process or a pour-coating process may be utilized to paint hollow objects of this type. There are certain advantages and disadvantages inherent to each of these processes. In the immersion process the largest possible submersion vats are used, depending on the size of the parts to be coated and the required throughput rate. If hollow objects are to be coated in the immersion process, a problem is encountered in that the hollow objects have to be filled completely with the paint, without air bubbles, when immersed and that for this reason they must enter the submersion bath with the opening upward whereas after treatment, i.e. after surfacing from the submersion bath, they have to be emptied again, i.e. the opening must be turned downward. This necessitates complex engineering for the conveyor devices for the hollow objects. A process of this type is, for instance, described in European Patent Application 0 118 756.

In the electrophoretic flow-coating process a coating is applied by simply flow-coating or pour-coating an object with the assistance of an electrophoretic paint. Here it is to be noted that the velocity of the paint as it flows over the object is subject to narrow limits so as not to interfere with the formation of the coating. Furthermore, it is possible in this fashion to apply a coating to only one surface, in hollow objects only to the outer surface.

To reach the inside of hollow objects as well, it has been further suggested in German published examined patent application 26 33 179 that a nozzle tube be inserted into the hollow objects which are passed along and above a catch basin and to cause the liquid electrophoretic coating material to flow through the nozzle pipe and onto the inside surface of the hollow object while this hollow object is being rotated around its axis. A particularly complicated mechanism is required in this process since the hollow objects must be held in a suitable holder and rotated around their own axes while in addition the nozzle pipes have to be inserted axially into the hollow objects and then retracted. Furthermore, in the flow-coating and nozzle pipe processes, both requiring a catch basin, considerable foam formation take place which must be counteracted either by mechanical means which require a considerable amount of space or by chemical means which interfere with the properties of the electrolytic liquid.

SUMMARY OF THE INVENTION

The object of the invention is to devise a process to coat hollow objects in an immersion process in which it is not necessary to rotate the hollow objects as they are introduced into the submersion bath or when leaving the same and with which it is possible to coat the outside and inside surfaces of the hollow objects uniformly and in a single step without unfavorable foam formation being encountered.

Based on this objective, it is proposed by way of invention that in a process of the nature mentioned at the outset the hollow objects be completely immersed, with the opening downward, in a submersion bath, that the openings be moved into the vicinity of nozzles for the paint located beneath the surface of the liquid in the submersion bath and that the air trapped in the hollow objects immersed in the submersion bath be at least partially displaced by the paint discharging from the nozzles. Due to the complete immersion of the hollow objects in the submersion bath, the outside surface is wet completely so that coating takes place immediately after immersion. In order to also apply a continuous layer of paint to the inside surface, the paint is injected into the hollow objects by means of nozzles located beneath the surface of the liquid, displacing at least partially the trapped air and filling the hollow objects. By so doing the inside surface is completely covered with a layer of paint so that here again a complete and non-porous coating is the result.

In consideration of the fact that the nozzles, when referenced to the enclosed space within the hollow objects, are practically at the level of the surface of the liquid, a sufficiently powerful stream of liquid is generated, which rises to the inside surface of the bottom of the object and displaces the air trapped inside.

When they are removed from the submersion bath, the hollow objects drain completely since the openings continue to face downwards; excess paint drips off and the coated hollow objects can subsequently be subjected to further usual treatments, such as rinsing and drying.

To support draining, air nozzles can be positioned in the submersion bath, downline of the paint nozzles; the air displaces the paint from the hollow objects.

If one wishes to displace entirely the air trapped in the hollow objects, it is advantageous to pass the hollow objects, once they have been immersed in the submersion bath, first into an area with a first group of nozzles and subsequently into an area with a second group of nozzles. The streams of liquid generated by the second group of nozzles not only displace completely the trapped air but also effect such active flow and turbulence in the hollow objects that quick coating is ensured.

Based on the above mentioned objective, proposed further by way of invention is a device of the type mentioned at the outset, exhibiting a paint-filled submersion bath, a conveyor device which immerses the hollow objects with the opening downwards completely in the submersion bath and removes them from the bath, and nozzles for paint which are located beneath the surface of the liquid in the submersion bath, directed into the openings of the hollow objects immersed in the submersion bath.

The conveyor device can comprise a wheel which dips into the submersion bath and which is fitted with holders for the hollow objects. The hollow objects are clamped to the holders outside the submersion bath manually or by means of automatic devices; as the wheel continues to turn the objects are immersed with the opening downwards into the submersion bath. As the hollow objects pass by the nozzles the air will be at least partially displaced from the hollow objects and the nozzles will apply a continuous coating layer to the inside surfaces of the hollow objects. When the hollow objects surface from the submersion bath they drain and can then be removed from the wheel and forwarded to the usual subsequent processes.

The conveyor device can preferably comprise a guide channel, the lower surface of which exhibits intermittent openings at least in part, and of which at least a section is below the surface of the liquid, and which carries the hollow objects in a loose group. This guide channel keeps the hollow objects together in a group and moves them below the surface of the liquid; the hollow objects can be pushed through the guide channel by means of a pusher unit located outside the submersion bath, for example.

It is also possible to position, along the axis of motion for the hollow objects and ahead of the nozzles previously mentioned, further nozzles directed into the openings of the hollow objects immersed in the submersion bath which serve essentially to displace the greatest part of the air trapped in the hollow objects while only subsequently will complete displacement and intensive agitation of the paint injected into the hollow objects take place with the support of further nozzles in the vicinity of that section of the conveyor device which is immersed the deepest in the submersion bath.

To achieve this, at least that section of the guide channel most deeply immersed in the submersion bath may comprise a pair of conveyor belts with intermittent openings, which engage the hollow objects at their upper and lower ends, interrupted at least in the area engaging the lower, open end of the hollow objects, whereby at least a part of the nozzles may be located in the area beneath the conveyor belt which engages with the lower ends of the hollow objects. Here the streams of paint discharging from the nozzles pass through the conveyor with its intermittent openings and penetrate into the hollow objects held between the pair of conveyor belts and support the coating action.

To support draining the hollow objects as they leave the submersion bath, nozzles for gas, preferably air, may be located in the submersion bath, under the surface of the liquid, and directed into the openings in the hollow objects immersed in the submersion bath and located downline from the nozzles for the paint.

Other objects and features of invention are described in detail below on the basis of an embodiment illustrated in the drawings.

DESCRIPTION OF A PREFERRED EMBODIMENT

Figure 1:
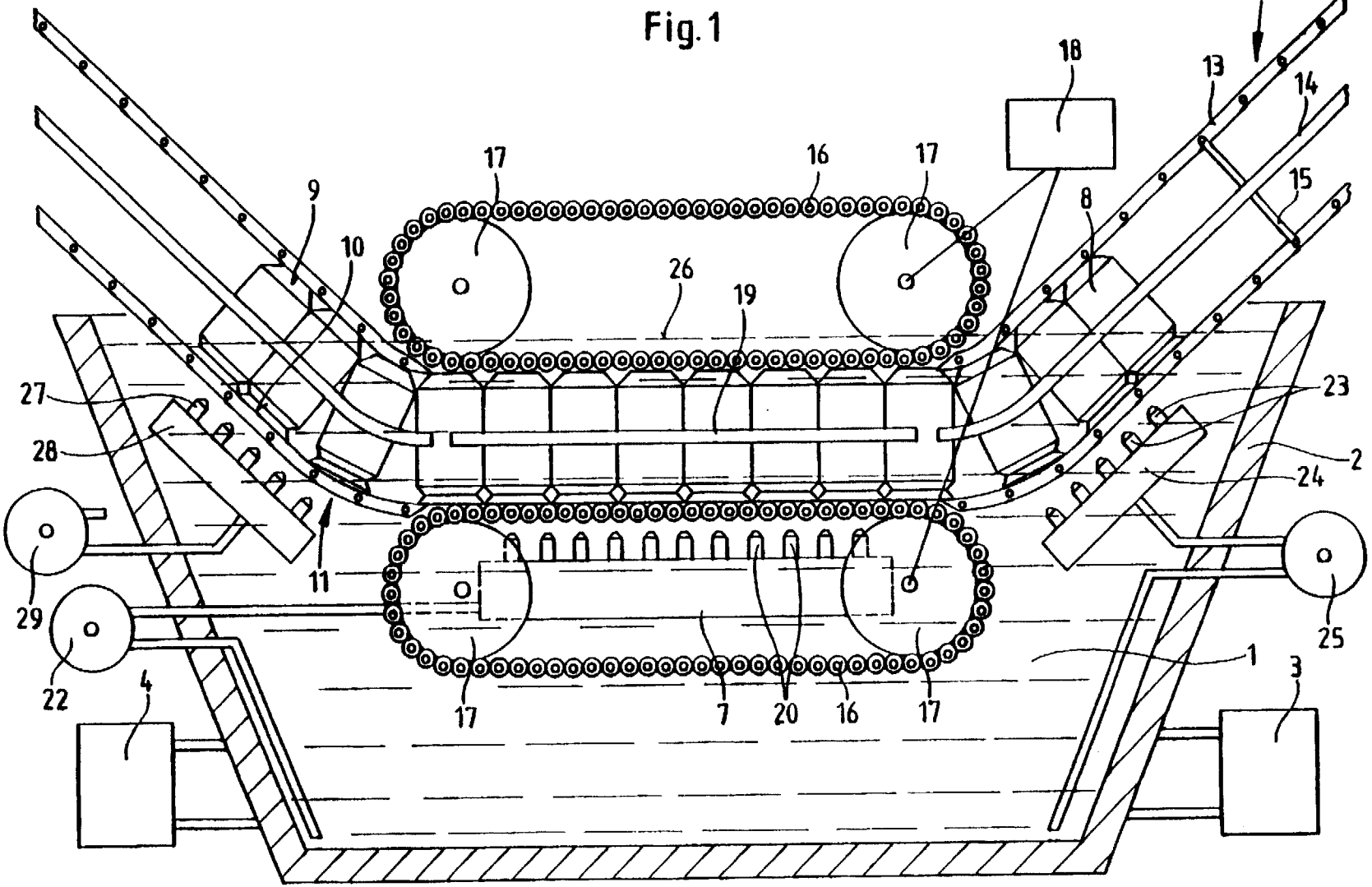
FIG. 1 shows a section through a submersion bath used to coat beverage cans.
Figure 2:
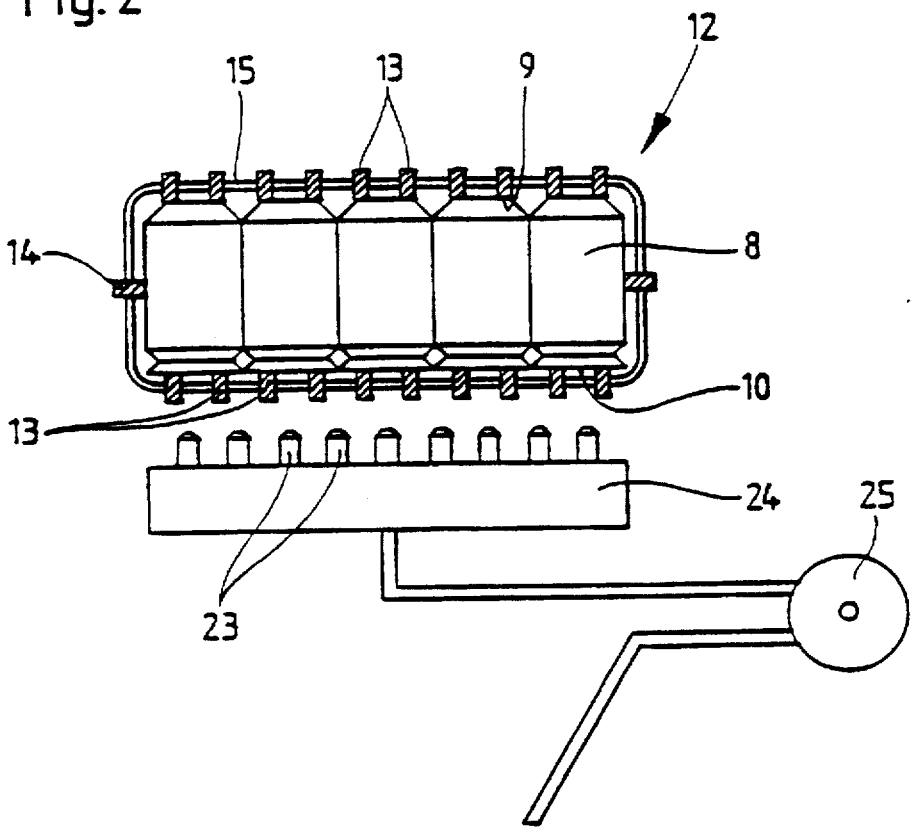
FIG. 2 shows a section through a guide channel for beverage cans to be coated in the submersion bath.

Of a system used for coating, only a submersion bath 1 filled with paint and located in a vat 2, is illustrated.

Ahead of the submersion bath 1 there are normally devices, not illustrated here, for cleaning, rinsing and possibly drying the objects to be treated.

In the same fashion there are located downline from the submersion bath 1 devices for drying the coated containers. This is known technology that need not be described in detail.

Hollow objects are to be coated on the inside and outside in submersion bath 1, these being beverage cans 8 in the example. These beverage cans 8 are guided with their bottom ends 9 upward and their top ends 10, which represent the upper edge of the beverage cans 8 and which exhibit an opening 11, downward inside a guide channel 12 and beneath the surface of the liquid 26 in the submersion bath 1.

The guide channel 12 comprises sections leading into the submersion bath 1 and out of the submersion bath 1, made of parallel upper and lower longitudinal rails 13 as well as lateral guide rails 14, these being joined by means of spacers 15 and forming a closed channel.

Within the section immersed in the submersion bath 1 the guide channel is comprised of a pair of link belts 16. Each link belt 16 passes continuously around a pair of reversing rollers 17 which are connected to a drive 18. The lateral limits of the guide channel in this section are defined by lateral guide rails 19. The beverage cans 8 are passed in a loose group through the guide channel 12; they are pushed into the section of the guide channel which is immersed in the submersion bath 1 and then engaged by the pair of link belts 16. This guiding of the beverage cans 8 on all sides has the effect that they are immersed in the paint in the submersion bath 1 without floating to the surface.

To coat the inner surface of the beverage cans 8, the air trapped inside the beverage cans 8 when they are immersed in the submersion bath 1 is displaced by paint by directing streams of paint through nozzles 23 which are arranged on a manifold 24, between the longitudinal rails 13 and the spacers 15 and toward the openings 11 in the beverage cans 8. The paint is drawn in by a recirculating pump 25 in the submersion bath 1. The discharge orifices in the nozzles 23 are positioned as near as possible in the vicinity of the openings 11 so as to inject the paint into the interior space within the beverage cans 8 at the greatest possible energy and to displace the trapped air at least in part.

Streams of paint are directed from underneath and into the beverage cans 8 through additional nozzles 20 located on a manifold 7. For this purpose the manifold 7 with the nozzles 20 is situated beneath the lower link belt which is in contact with the beverage cans 8 and which exhibits so many openings for the streams of paint that these streams can pass essentially unhindered through the link belt 16 and reach the bottom 9 of the beverage cans 8.

The streams of paint discharged from the nozzles 20 and 23 displace the air from the space inside the beverage cans 8 more or less completely, whereby air bubbles which might possibly remain will not interfere since the inside surface of the beverage cans is always covered with a continuous layer due to the energetic motion of the paint inside the beverage cans 8 due to the jet effect of the nozzles 20.

Following the pair of link belts 16 the beverage cans 8 pass again into a guide channel section made up of longitudinal rails 13, lateral guide rails 14 and spacers 15 and are moved out of the submersion bath 1. Upon exiting the submersion bath 1 the beverage cans 8 drain; excess paint residues drip back into the bath. This draining is supported by blowing air through air nozzles 27 into the hollow spaces in the beverage cans 8 by which means the paint is displaced. The air nozzles 27 are located on a manifold 28 which is charged with compressed air by an air pump 29.

The beverage cans are then further processed in the usual fashion.

With the process and the device proposed by way of invention a very short coating time, particularly at the inside of the beverage cans, is achieved with completely uniform and dense coating. The system can be operated in the normal fashion as an immersion painting process with just a single submersion vat. As opposed to the flow-coating or spray pipe process, the formation of foam is avoided or at least reduced considerably and if the guide channel 12 illustrated is used, the beverage cans or other hollow objects can be moved in a loose group and in simple fashion, without having to grasp them individually. The device which is the subject of the invention makes it possible to coat electrophoretically and without difficulty 2000 to 3000 cans per minute.

If such high capacity for the coating of the inside surface of hollow objects is not required, these hollow objects can also be positioned on a wheel with a horizontal axis of rotation, whereby the hollow objects are attached to the wheel outside the submersion bath, pass through the submersion bath and then are removed again in order to further process them in the normal way.

Decisive in the process proposed by way of invention and the corresponding device are that hollow objects is immersed in a submersion bath with the opening downward, that paint is applied at the downward facing openings in the hollow objects by means of streams of paint discharged from nozzles located beneath the surface of the paint, this being done in such a way that the air trapped in the hollow objects is displaced, that the inside surface of the hollow object is covered uniformly with a continuous layer of paint in motion, and that this gives a uniform coating of the inside surface.

I claim:

1. A device for coating hollow objects, each hollow object having an opening therein, the device comprising:

a vat for containing a submersion bath comprising a coating material;

a conveyor device for supporting the hollow objects with their openings downward and for immersing the hollow objects in the submersion bath and for then removing the hollow objects from the bath; the conveyor device comprising a guide channel for guiding the hollow objects into and out of the submersion bath, the channel having a lower side which is open at least in some areas thereof, and at least some sections of the channel being structured and arranged with respect to the bath for supporting openings of the hollow objects beneath the surface of the bath;

at least one nozzle in the vat for supplying coating material, the nozzle and the conveyor being structured and arranged with respect to each other such that the conveyor device conveys the hollow objects with respective openings of the hollow objects moved into the vicinity of the nozzle such that the nozzle directs coating material into the openings of the hollow objects then immersed in the submersion bath, the nozzle being adapted to generate a stream of coating material having a velocity sufficient to rise to an inside surface of the bottom of the hollow objects then immersed in the bath so that air inside the hollow objects is displaced; and a second nozzle in the vat for supplying gas, the second nozzle being located downstream in a guide path of the hollow objects from the nozzle for the coating material, and being structured and arranged with respect to the conveyor device so that the second nozzle directs gas into the openings of the hollow objects then immersed in the submersion bath.

2. A device for coating a plurality of cans having a top and cylindrical side wall with an opening, each can having an opening therein, the device comprising:

a vat for containing a submersion bath comprising a coating material;

a conveyor to guide and support the cans with their openings continuously facing downward and immersing the cans in the submersion bath and then removing the cans from the bath with their openings still facing downwards, the cans having a buoyancy relative to the coating material which, if unguided and unsupported, would make them float on the surface of the submersion bath, the conveyer immersing the cans in the immersion bath such that the cans do not float to the surface of the immersion bath;

at least one nozzle in the vat for supplying coating material, the nozzle and the conveyor being structured and arranged with respect to each other such that the conveyor device conveys the cans with respective openings of the cans moved into the vicinity of the nozzle such that the nozzle directs coating material into the openings of the cans then immersed in the submersion bath, the nozzle being adapted to generate a stream of coating material having a velocity sufficient to rise to an inside surface of the bottom of the cans then immersed in the bath so that air inside the cans is displaced while the cans are held by said conveyer with their openings downward; and a second nozzle in the vat for supplying gas, the second nozzle being located downstream in a guide path of the cans from the nozzle for the coating material, and being structured and arranged with respect to the conveyer device so that the second nozzle directs gas into the openings of the cans then immersed in the submersion both.

3. A system comprising a device for coating a plurality of cans and a plurality of cans, said cans each having a top and cylindrical side wall and an opening further comprising:

a vat containing a submersion bath comprising a coating material;

a conveyer supporting and guiding the cans with their openings continuously facing downward, and immersing the cans in the submersion bath, and then removing the cans from the bath with their openings still facing downwards, the cans having a buoyancy relative to the coating material which, if unguided and unsupported, would make them float on the surface of the submersion bath, the conveyor immersing the cans in the immersion bath such that the cans do not float to the surface of the immersion bath;

at least one nozzle in the vat for supplying coating material, the nozzle and the conveyer being structured and arranged with respect to each other such that the conveyer device conveys the cans with respective openings of the cans moved into the vicinity of the nozzle such that the nozzle directs coating material into the opening of the can then immersed in the submersion bath, the nozzle being adapted to generate a stream of coating material having velocity sufficient to rise to an inside surface of the bottom of the can then immersed in the bath so that air inside the cans is displaced while the cans are held by said conveyor with their openings downward; and a second nozzle in the vat for supplying gas, the second nozzle being located downstream in a guide path of the cans from the nozzle for the coating material, and being structured and arranged with respect to the conveyor device so that the second nozzle directs gas into the openings of the cans then immersed in the submersion bath.

4. A device for coating a plurality of cans, each of said cans having a top and cylindrical side wall, the device comprising a vat for containing a submersion bath comprising a coating material;

a conveyor adapted to guide support said cans in a side-by-side relationship with their openings continuously facing downward and for immersing the cans in the submersion bath and for then removing the cans from the bath, all while said cans are held in a side-by-side relationship with their openings still facing downwards, the cans having a buoyancy relative to the coating material which, if unguided and unsupported, would make them float on the surface of the submersion bath, the conveyor immersing the cans in the immersion bath such that the cans do not float to the surface of the immersion bath;

at least one nozzle in the vat for supplying coating material, the nozzle and the conveyor being structured and arranged with respect to each other such that the conveyor device conveys the cans with the respective openings of the cans moved into the vicinity of the nozzle such that the nozzle directs coating material into the openings of the can then immersed in the submersion bath, the nozzle being adapted to generate a stream of coating material having a velocity sufficient to rise to an inside surface of the bottom of the cans then immersed in the bath so that air inside the cans is displaced while the cans are held by said conveyor with their openings downward; and a second nozzle in the vat for supplying gas, the second nozzle being located downstream in the guide path of the cans from the nozzle for the coating material, and being structured and arranged with respect to the conveyer device so the second nozzle directs gas into the openings of the cans then immersed in the submersion bath.

* * * * *